United States Patent [19]

Basaldua

[11] 4,062,062

[45] Dec. 13, 1977

[54] MULTI-STYLE GARMENT

[75] Inventor: Lydia Silvestry Basaldua, London, England

[73] Assignee: Lydia Design Ltd., New York, N.Y.

[21] Appl. No.: 716,474

[22] Filed: Aug. 23, 1976

[51] Int. Cl.[2] ..... A41D 1/22

[52] U.S. Cl. ..... 2/105; 2/243 B

[58] Field of Search ..... 2/105, 243 B, 69.5, 2/69, 74, 75, 67, 52, 72, 106

[56] References Cited

U.S. PATENT DOCUMENTS

| | | | |
|---|---|---|---|
| 1,886,049 | 11/1932 | Rolhblum | 2/67 |
| 3,160,891 | 12/1964 | MacDonald | 2/69 |
| 3,877,078 | 4/1975 | Tepper | 2/74 |

FOREIGN PATENT DOCUMENTS

| | | | |
|---|---|---|---|
| 2,460,048 | 6/1976 | Germany | 2/105 |

*Primary Examiner*—Werner H. Schroeder
*Assistant Examiner*—Doris L. Troutman
*Attorney, Agent, or Firm*—McAulay, Fields, Fisher & Goldstein

[57] ABSTRACT

A garment which is adapted to be worn in a plurality of different styles. The garment comprises a lower tubular portion adapted to encircle portions of the body. Additionally, an upper tubular portion forms an extension of the lower portion. The upper portion comprises opposed scarves having spaced front and rear edges wherein each scarf extends from the front edge to the rear edge. The scarves are adapted either to enfold or to be draped about the body in various configurations to support the garment on the wearer.

17 Claims, 12 Drawing Figures

34
32
30
26
24
28
36
38
10
18
22
16
20
14
12
23
42
13
40
110
114
112
52
54
48
46
50

MULTI-STYLE GARMENT

This invention relates generally to a garment and, more particularly, pertains to a garment that may be worn in a number of different ways to produce the appearance of a plurality of different garments.

When a woman desires differently styled garments for a particular occasion, such as evening wear or the like, she is required to purchase a number of different garments commensurate with a number of such styles. For example, if a gown with a plunging neckline and a gown with a high neckline is desired, two different types of gowns must be purchased. This obviously places an economic burden on the average working woman and, in many instances, causes the purchaser to select one of the styles rather than both gowns.

In addition, a problem is encountered when a number of differently styled garments are desired for wear during a vacation. That is, the selection of garments is limited by the space available for packing. Moreover, if the garments are wrinkled or creased during traveling, the cost to press or iron the same will naturally increase in proportion to the number of garments packed. As a result, the wearer will be severely limited in the number of different styles of garments that may be worn during a vacation. This problem becomes manifest during long vacations when the same clothes must be worn for a number of different occasions.

Accordingly, an object of the present invention is to provide an improved garment construction.

A more specific object of the present invention is to provide a garment construction that may be worn in a plurality of different styles.

A further object of the invention resides in the novel details of construction that provide a single garment that is comfortable to wear and may be fashioned into any style suitable for the particular occasion for which it is to be worn.

Accordingly, a garment constructed in accordance with the present invention comprises a lower tubular portion adapted to surround portions of the body of the wearer. A pair of opposed scarves extend upwardly from the tubular portion and form an extension thereof. The scarves are adapted to be wrapped around portions of the body of the wearer thereby to support the garment on the wearer.

A feature of the present invention is to provide a garment of the type described in varying lengths so that the same is suitable for beachwear, swimwear or the like.

Other features and advantages of the present invention will become more apparent from a consideration of the following detailed description, when taken in conjunction with the accompanying drawings, in which.

Figures 1, 2, 7:
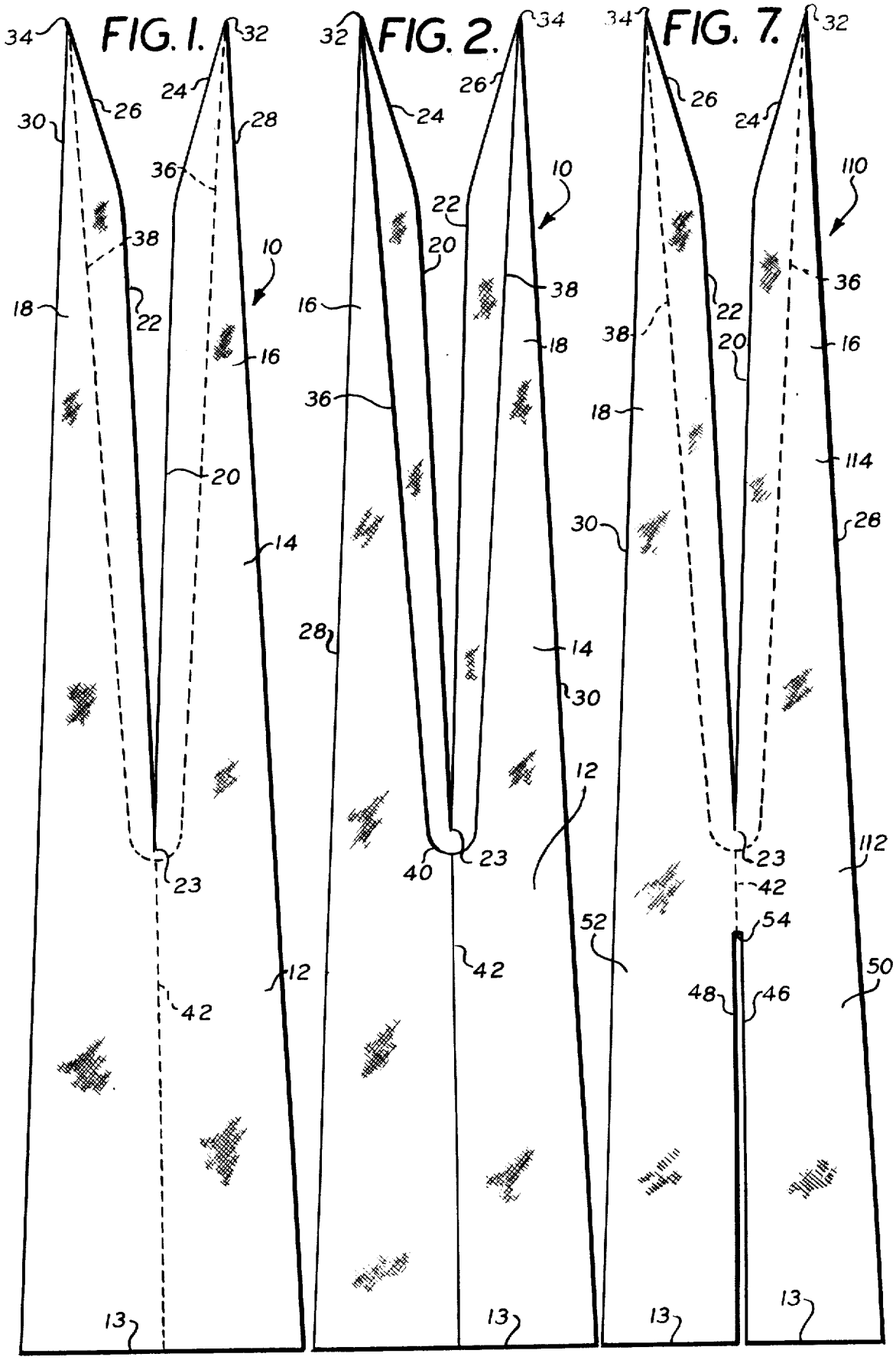
FIG. 1 is a front elevational view of a garment constructed according to the present invention.
FIG. 2 is a rear elevational view thereof.
FIG. 7 is a front elevational view of a modified embodiment of a garment constructed according to the present invention as used for a jumpsuit.

A garment constructed according to the present invention is designated generally by the reference character 10 in FIGS. 1 and 2 and comprises a lower portion 12 and an upper portion 14. Although FIGS. 1 and 2 illustrate the garment in elevation with the front surface in contact with the rear surface, it is to be understood that when the garment is worn, the lower portion 12 is tubular in cross section. The upper portion 14 comprises opposed scarves or scarf ends 16 and 18.

The opposed front edges 20 and 22 of the respective scarves 16 and 18 taper upwardly and outwardly away from each other, as shown in FIG. 1. The edges 20 and 22 meet substantially in the center of the garment at 23 to form a "V". Additionally, the upper portions 24 and 26 of the respective edges 20 and 22 taper upwardly and outwardly at a greater angle than the edges 20 and 22 and converge with the respective side edges 28 and 30 to form points 32 and 34. As shown in the FIGS. the side edges 28 and 30 taper inwardly form the bottom edge 13 to the top of the garment and form continuous lines in elevation.

The scarves 16 and 18 extend from the respective front edges around the side of the dresses and terminate at respective rear edges 36 and 38. As shown in FIG. 2, the rear edges 36 and 38 taper upwardly and outwardly and meet at an arcuate edge 40 which is spaced slightly below the junction 23 of the edges 20 and 22. Additionally, the taper of the edges 36 and 38 is such that the edges extend continuously from the arcuate edge 40 to the respective points 32 and 34. A substantially centrally located seam 42 extends from the bottom edge of the dress to the arcuate edge 40. The scarves 16 and 18 are sized so that the front surface of the scarves extends beyond the rear edges thereof. In other words, the rear edges 36 and 38 of the scarves are spaced outwardly from the front edges 20 and 22. It is highly desirable that the scarves be fashioned as described, otherwise they will not hang correctly when the garment is worn on the body. For example, if a seam is placed across the top of the scarves, the scarves will remain open rather than draping in long, flowing lines.

Figure 3:
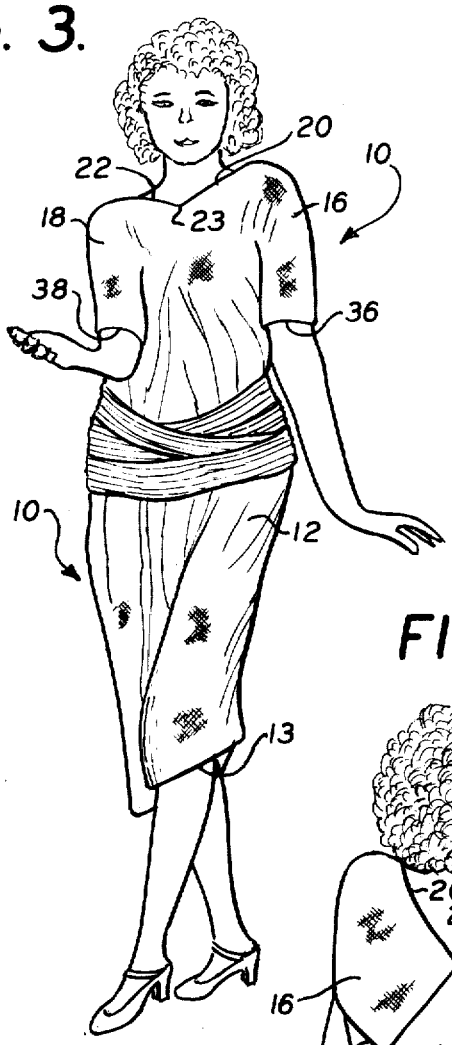
FIG. 3 is a perspective view, as viewed from the front, of one style of wear of the garment shown in FIGS. 1 and 2.
Figure 4:
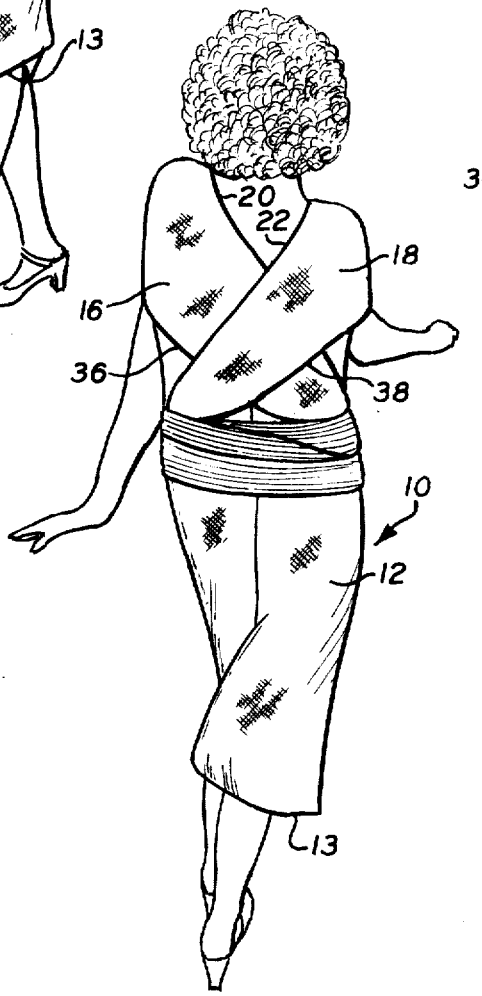
FIG. 4 is a perspective view, as viewed from the rear, of the style of wear shown in FIG. 3.

In an actual embodiment of the garment shown in FIGS. 1 and 2, the garment was fabricated from rayon jersey. While the invention is not limited to the particular material used for the garment, it is highly desirable that the material have a sufficient coefficient of friction such that the folds of the garment will not slip relative to one another when the garment is worn. The length of the garment was 3 meters. The length of the lower tubular portion was 1½ meters while the scarf lengths were 1½ meters. The seam 42 was approximately 2.54 cm. and all of the edges of the garment were hand-rolled. While the garment 10 may be worn in many ways to produce numerous styles of wear, one such style is shown in FIGS. 3 and 4. Accordingly, the tubular portion 12 surrounds almost the entire body of the wearer so that the junction 23 of the edges 20 and 22 is positioned slightly below the neck of the wearer. The scarves 16 and 18 extend over the respective shoulders of the wearer and around the upper arms to give the appearance of sleeves, as viewed from the front. The scarves are crossed at the back of the wearer, as shown in FIG. 4, and the ends of the scarves are wrapped about the waist of the wearer and tucked under the folds. Thus, the overall effect of the garment is to produce a so-called "flapper-style" dress. The height of the lower edge 13 of the dress may be adjusted by gathering the garment in folds at the waist underneath the area occupied by the scarf ends. As noted above, the coefficient of friction of the garment is such that the garment will retain such folds without falling down. In practice, it has been found that rayon jersey provides such coefficient of friction.

Figure 5:
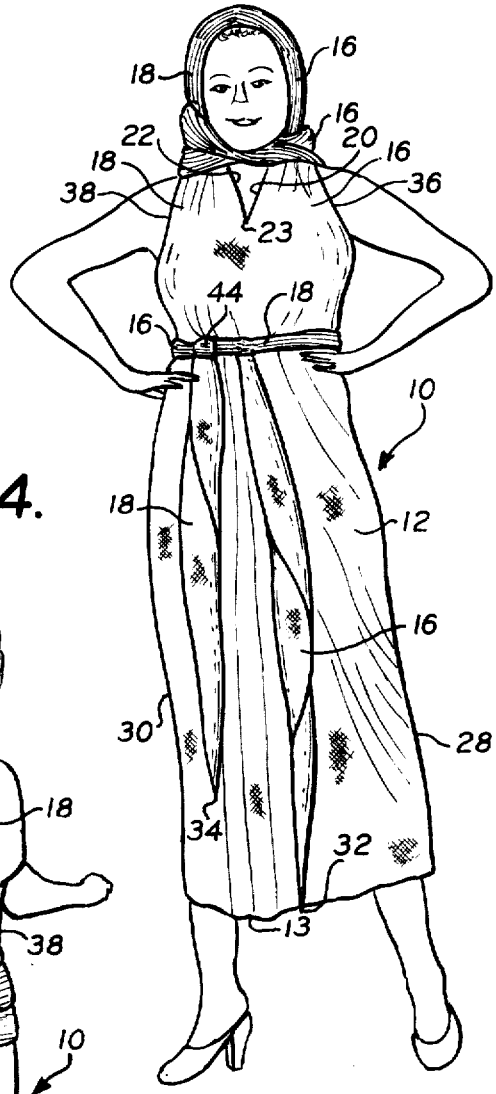
FIG. 5 is a front elevational view, as viewed from the front, of another style of wear of the garment shown in FIGS. 1 and 2.
Figure 6:
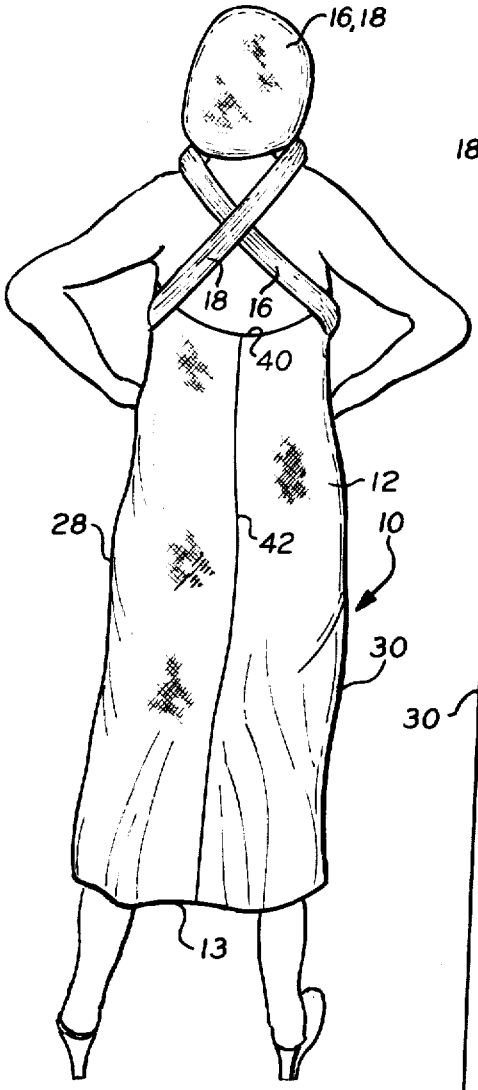
FIG. 6 is a rear view of the style of wear shown in FIG. 5.

FIGS. 5 and 6 illustrate another style of wear of the garment 10 which produces a radically different style than the shown in FIGS. 3 and 4. The style shown in FIGS. 5 and 6 is a sleeveless garment that appears to have a hood.

To be more specific, the tubular portion 12 encircles the body of the wearer and the dress is positioned so that the junction 23 of the scarves 16 and 18 are located below the neck by a distance sufficient to permit the edges 20 and 22 to form a sharp "V". The scarves 16 and 18 are gathered in the vicinity of the shoulders so that the garment appears sleeveless. However, the scarves are then opened and wrapped about the head of the wearer. The scarves are permitted to drap down in the back to give the illusion of a hood that covers the entire head of the wearer. The scarf ends are then gathered and crossed in front of the neck. The ends of the scarves are then crossed at the back of the wearer, as shown in FIG. 6 and are brought forward about the waist of the wearer and tied at 44.

It is again emphasized that the ends of the scarves terminate in points rather than in a blunt seam to permit the scarves to hang gracefully as shown in FIG. 5. If the scarves were provided with seams across their ends, the scarf ends would simply remain open rather than assume the shape shown in FIG. 5.

It will be evident that the style shown in FIG. 5 does not even remotely resemble the style shown in FIG. 3. In fact, it would appear that two completely different garments were being worn by the wearer. While the FIGS. illustrate only two different styles of wear, the garment may be converted into an innumerable number of different styles.

Accordingly, a single garment has been disclosed which is capable of being worn in a plurality of different styles to give the impression that the person is wearing a number of different types of garments.

FIG. 7 illustrates a modified embodiment of a garment 110 constructed according to the present invention. That is, the garment of FIGS. 1 and 2 may be worn as a dress or a gown. On the other hand, the garment 110 is a so-called "jumpsuit". Like numbers in the various FIGS. indicate identical elements. Accordingly the upper portion 114 of the garment 110 is identical to the upper portion 14 of the garment 10. However, the lower portion 112 of the garment 110 is formed into trousers. That is, the rear surface of the dress is sewn to the front surface of the dress along the respective centrally located seams 46 and 48 to form respective legs 50 and 52. Additionally, the front and rear surfaces are sewn together along a croch seam 54. The seam 54 is positioned below the junction 23 of the edges 20 and 22 by a distance of approximately 0.3 - 0.4 meters.

The jumpsuit 110 is worn in the same manner as the garment 10 with the exception that the wearer inserts her feet into the respective legs 50 and 52. The scarves 16 and 18 may then be oriented in any desired manner to produce the desired style of wear.

Figure 8:
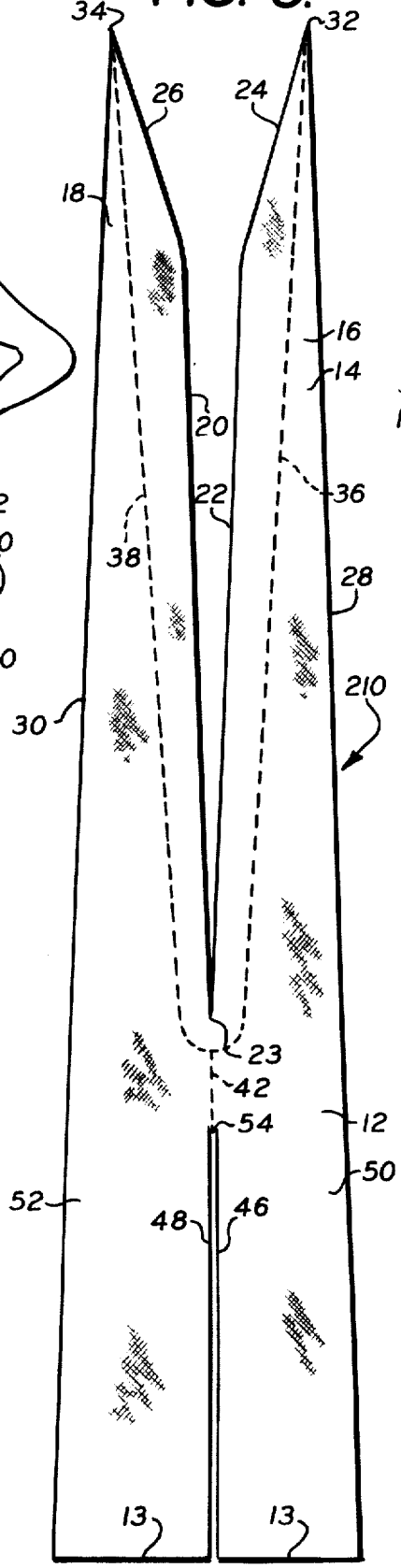
FIG. 8 is a front elevational view of a further modified embodiment of a garment constructed according to the present invention as used for sportswear.

FIG. 8 illustrates a further modified embodiment of the present invention which is similar to the jumpsuit shown in FIG. 7. The garment 210 of FIG. 8 is adapted to be worn for sportswear or as a sportsuit and accordingly is provided with trousers or legs 50 and 52 similarly to the jumpsuit 110. However, the overall length of the sportsuit of FIG. 8 is approximately 2¼ meters. The lower trouser portion 212 has a length of ¾ meters while the upper portion or scarf portion has a length of 1½ meters. In practice, the sportsuit 210 is fabricated from a blend of nylon and polyester and has a stretchability or a stretch factor of approximately 300%. That is, the garment will stretch in the breadth and length up to the maximum of 300%. The sportsuit may be worn in the same manner as the jumpsuit 110.

Figure 9:
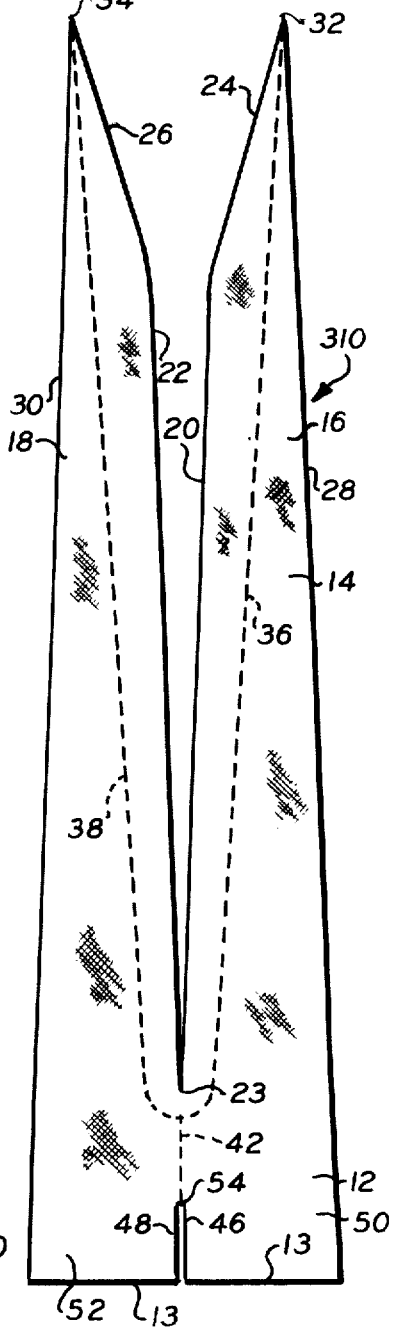
FIG. 9 is a front elevational view of another modified embodiment of a garment constructed according to the present invention as used for beachwear.

FIG. 9 illustrates beachwear or swimwear 310 that is similar in construction to the sportsuit 210. However, the overall length of the swimsuit 310 is 2 meters and the length of the lower portion 12 is ¼ meter and the length of the scarves 16 and 18 is 1¾ meters. In practice, the swimwear 310 is fabricated from a blend of cotton, acrylic and polyester and has a stretchability of 200%. That is, the fabric may stretch in the length and the breadth up to a factor of 200% of its original dimension.

Figure 10:
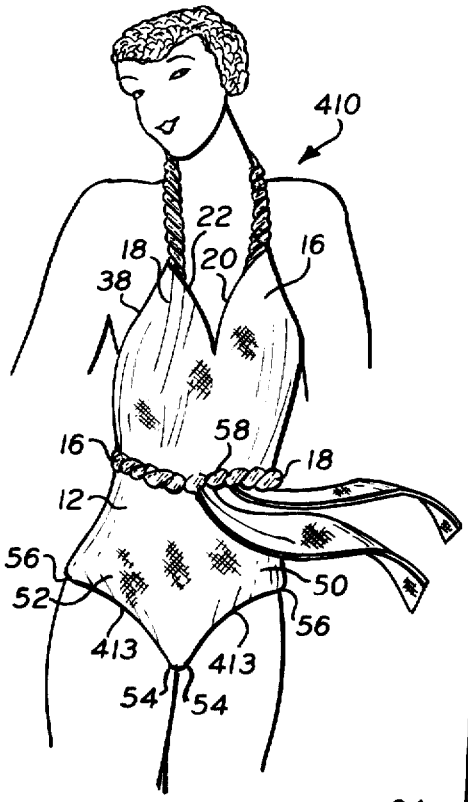
FIG. 10 is a perspective view, as viewed from the rear, of another modified embodiment of a garment as used for swimwear.
Figure 11:
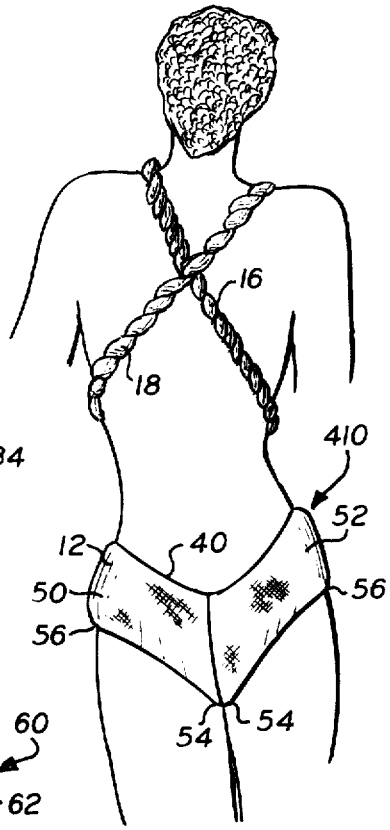
FIG. 11 is a front elevational view of the garment shown in FIG. 10.

FIGS. 10 and 11 illustrate a further form of beachwear or swimsuit which is designated by the reference character 410. The swimsuit 410 is identical to the swimsuit 310 with the exception of the lower edges. That is, the lower edges 413 of each of the legs 50 and 52 taper upwardly and outwardly from a low point 46 at the inside of the legs to an upper point 48 at the outside of the legs.

Additionally, FIGS. 10 and 11 illustrate one manner in which the swimsuit 410 may be worn. That is, the scarves 16 and 18 are brought to the front of the garment and are opened and extend upwardly to cover the bosom of the wearer. Beyond this point the respective scarves are twisted to form rope-like members that extend around the neck of the wearer and are crossed in the back and brought to the front of the swimsuit. At this point, the scarves are opened rather than twisted and tied in a bow 58.

Figure 12:
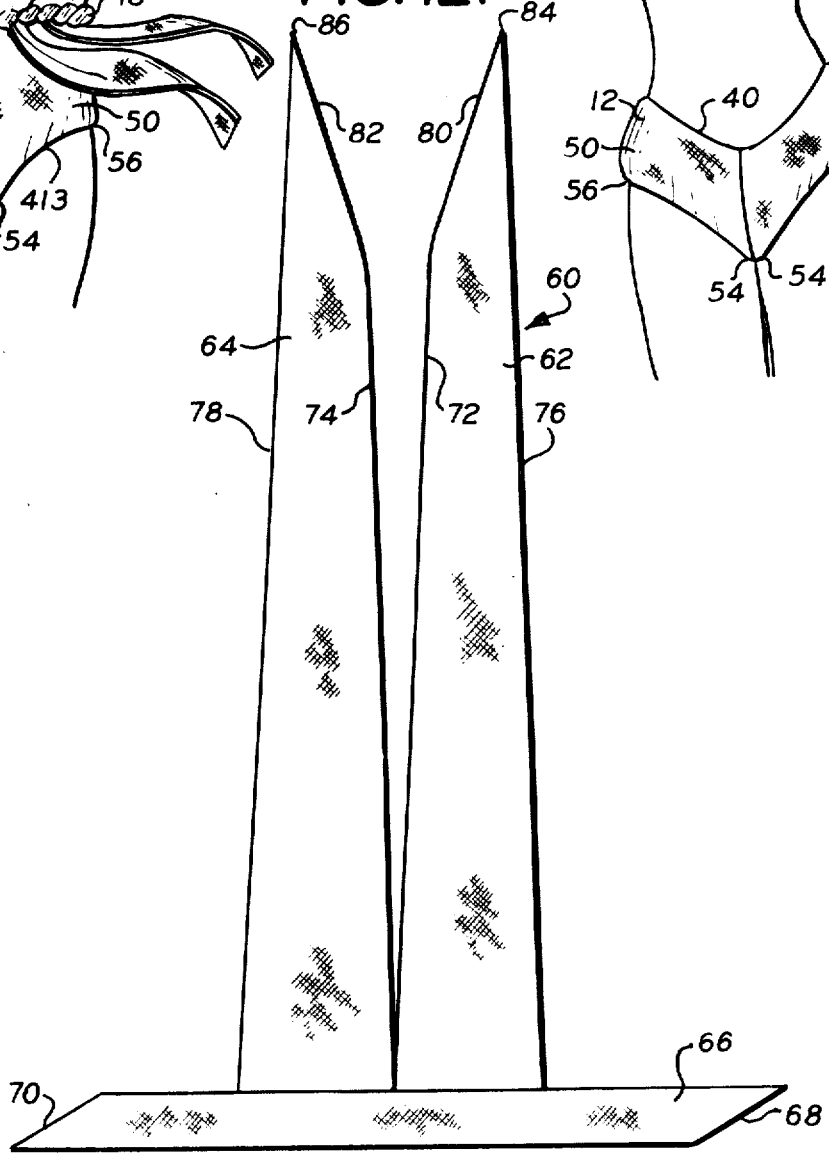
FIG. 12 is a front elevational view of a further modified embodiment of a garment constructed according to the present invention as used to be worn on the upper portion of the body.

FIG. 12 illustrates a top 60 which is provided with scarves 62 and 64 similarly to the above garments and which may be worn in a plurality of different styles to give the appearance of a number of different tops. More specifically, the top 60 includes a lower portion 66 in the form of a band having reversely tapered edges 68 and 70. The scarves 62 and 64 extend upwardly from the band 66 and comprise upwardly and outwardly tapering opposed inner edges 72 and 74. Additionally, the scarves have upwardly and inwardly tapering outer edges respectively designated 76 and 78. The upper portions 80 and 82 of the edges 72 and 74 taper upwardly and outwardly at a greater angle than the associated edges 72 and 74 and terminate at the respective edges 76 and 78 to form points 84 and 86. The top 60 is adapted to be worn in a manner similarly to the aforementioned garments.

That is, the lower portion 66 is adapted to encircle the waist and the ends of the top are tied at the back of the wearer. The scarves 62 and 64 may be fashioned in any manner desired similarly to the scarves 16 and 18 to provide a number of different styles for the top 60.

While preferred embodiments of the invention have been shown and described herein, it will be obvious that numerous omissions, changes and additions may be made in such embodiments without departing from the spirit and scope of the present invention.

What is claimed is:

1. A garment capable of being worn in a plurality of different styles comprising:

a lower tubular portion having side edges when viewed in elevation, said tubular portion being adapted to surround portions of the body of the wearer, and a pair of opposed scarves extending upwardly from said tubular portion, each one of said pair of scarves having a lower end connected to said tubular portion and an upper free end opposite said lower end which is adapted to be positioned in one of a plurality of different locations depending upon the style of wear of said garment, said pair of scarves forming an extension of said lower tubular portion and being adapted to be wrapped about portions of the body of the wearer, said scarves having respective side edges when viewed in elevation, opposed front edges and opposed rear edges, said opposed front edges of said scarves tapering upwardly and outwardly, and said rear edges of said scarves tapering upwardly and outwardly.

2. A garment as in claim 1, in which the side edges of said garment, in elevation, taper outwardly in a continuous line from the top of each one of said pair of scarves to the bottom of said tubular portion.

3. A garment as in claim 1, in which the taper of said opposed edges of said front portion of said scarves changes adjacent the top edges of said scarves, said upper taper being greater than said lower taper.

4. A garment as in claim 3, in which said opposed tapering edges of the front portion of said scarves meet to form a "V", and said opposed tapering edges of the rear portion of said scarves meet at a rounded bottom edge.

5. A garment as in claim 1, in which said garment has an overall length of approximately 3 meters, and said tubular portion has a length of approximately 1½ meters.

6. A garment as in claim 1, in which said garment is formed with a front and a rear portion and a seam extending vertically in said rear portion of said tubular portion and being substantially centrally located.

7. A garment as in claim 1, in which said garment is made of rayon jersey.

8. A garment as in claim 1, in which said lower tubular portion comprises a pair of leg sections, each one of said leg sections adapted to encircle a respective leg of the wearer, said leg sections terminating below the pair of scarves.

9. A garment as in claim 8, in which said tubular portion has a length of substantially 1½ meters, and said pair of scarves have a length of substantially 1½ meters.

10. A garment as in claim 8, in which said tubular portion has a length of substantially ¾ meters and said scarves have a length of substantially 1½ meters.

11. A garment as in claim 10, in which said garment is made from nylon and polyester materials, and has a stretchability of substantially 300%.

12. A garment as in claim 8, in which said tubular portion has a length of substantially ¼ meters, and said scarves have a length of substantially 1¾ meters.

13. A garment as in claim 12, in which said garment is made from a blend of cotton, acrylic and polyester materials.

14. A garment as in claim 12, in which the bottom edge of each leg section tapers upwardly and outwardly from the inner edge of the leg section to the outer edge thereof.

15. A multi-style garment comprising a lower and an upper tubular portion, said lower tubular portion being adapted to surround portions of the body of the wearer, said upper tubular portion forming an extension of said lower tubular portion and comprising a pair of spaced apart scarves, each one of said scarves having a lower end connected to said tubular portion and an upper free end opposite said lower end which is adapted to be positioned in a desired one of a plurality of different locations depending upon the style of wear of said garment, each one of said scarves extending from a first edge at the front of said garment around to a second edge at the rear of said garment.

16. A garment as is claim 15, in which said first edges of said pair of scarves taper upwardly and away from each other to form substantially a V-shape at the front of said garment, and said second edges of said pair of scarves taper upwardly and away from each other.

17. A garment as in claim 16, in which said second edge of each of said pair of scarves is spaced outwardly from the associated first edge of said scarf, whereby a portion of the front of each of said pair of scarves extends beyond the second edge thereof.

* * * * *